US006595659B2

(12) United States Patent
Wong

(10) Patent No.: US 6,595,659 B2
(45) Date of Patent: Jul. 22, 2003

(54) COLORFUL DECORATIVE LIGHT

(76) Inventor: Tsui-Tuan Wong, 15th Fl., No. 81, Sec. 1, Hsintai 5th Rd., Hsitzu Chen, Taipei Hsien (TW)

( * ) Notice: Subject to any disclaimer, the term of this patent is extended or adjusted under 35 U.S.C. 154(b) by 0 days.

(21) Appl. No.: 09/933,251

(22) Filed: Aug. 20, 2001

(65) Prior Publication Data

US 2003/0035288 A1 Feb. 20, 2003

(51) Int. Cl.[7] ..... F21V 11/00

(52) U.S. Cl. ..... 362/235; 362/219; 362/252; 362/806

(58) Field of Search ..... 362/249, 219, 362/235, 252, 806, 101

(56) References Cited

U.S. PATENT DOCUMENTS 6,379,021 B1 * 4/2002 Shieh ..... 362/123
6,406,166 B1 * 6/2002 Ko ..... 315/185 R

* cited by examiner

*Primary Examiner*—Sandra O'Shea
*Assistant Examiner*—Guiyoung Lee
(74) *Attorney, Agent, or Firm*—Danton K. Mak; Stephen R. Seccombe; Sheldon & Mak

(57) ABSTRACT

A colorful decorative light is disclosed. The colorful light includes a length of flexible core provided with mini-bulbs and wires electrically connecting to the mini-bulbs, and a substantially transparent outer covering encasing the core. In addition, a colorful and transparent cladding is arranged between the core and the outer covering, in order to provide a fancy decoration.

6 Claims, 2 Drawing Sheets

COLORFUL DECORATIVE LIGHT

BACKGROUND OF THE INVENTION

1. Field of the Invention

The present invention relates to a decorative light and, more particularly, to a colorful light which can provide a fancy decoration.

2. Description of Related Art

Decorative lights having a plurality of bulbs arranged in a length of a flexible core are known. In such a light, the flexible core is directly covered with a transparent outer covering that is either colorless or monocolor. The monotony or lack of variety of the decorative light in its color degrades the decoration its may provide.

Therefore, it is an objective of the invention to provide a colorful decorative light to mitigate and/or obviate the aforementioned problem.

SUMMARY OF THE INVENTION

The object of the present invention is to provide a colorful decorative light which can provide a fancy decoration.

Other objects, advantages and novel features of the invention will become more apparent from the following detailed description when taken in conjunction with the accompanying drawings.

DETAILED DESCRIPTION OF THE PREFERRED EMBODIMENT

Figure 1:
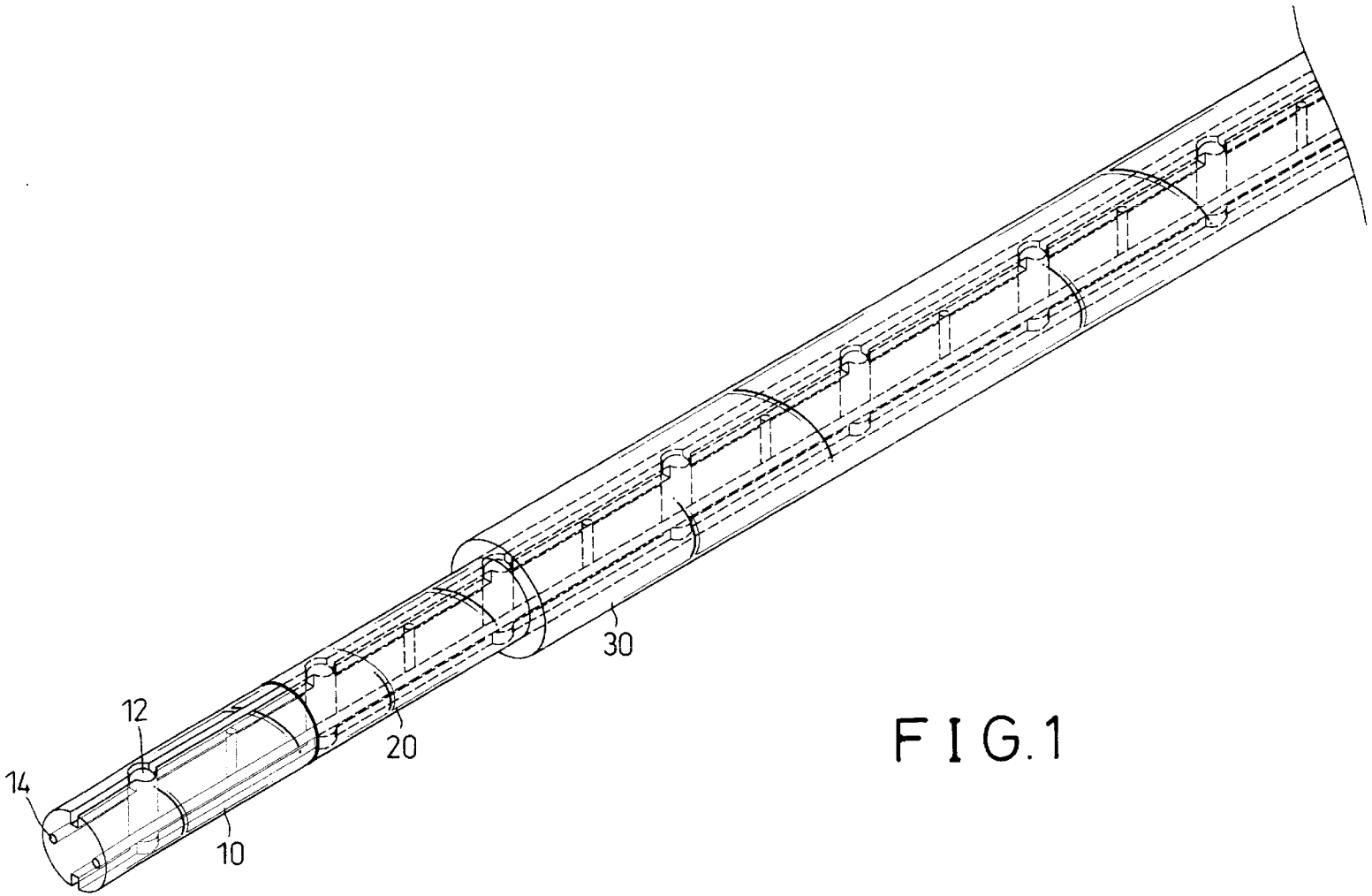
FIG. 1 is a fragmentary perspective view of a colorful decorative light in accordance with the present invention.

Referring to FIG. 1, a colorful decorative light in accordance with the present invention includes a length of flexible core (10) provided with mini-bulbs (12) and wires (14) electrically connecting the bulbs (12), and a substantially transparent outer covering (30) encasing the core (10).

A transparent and colorful cladding (20) is arranged between the core (10) and the outer covering (30). The cladding (20) may be arranged either in a series of lengths, as illustrated in FIG. 1, which can be of different colors or in spirals which can also be of different colors. The variety of colors, of course, provides the light with an optically attractive property, especially when it is lit.

It is conceivable that the cladding (20) can be made from a variety of materials, such as a coating of color paint, one or more colored bands wound around the core (10), or even a plurality of colored sleeves mounted around the core (10).

Figure 2:
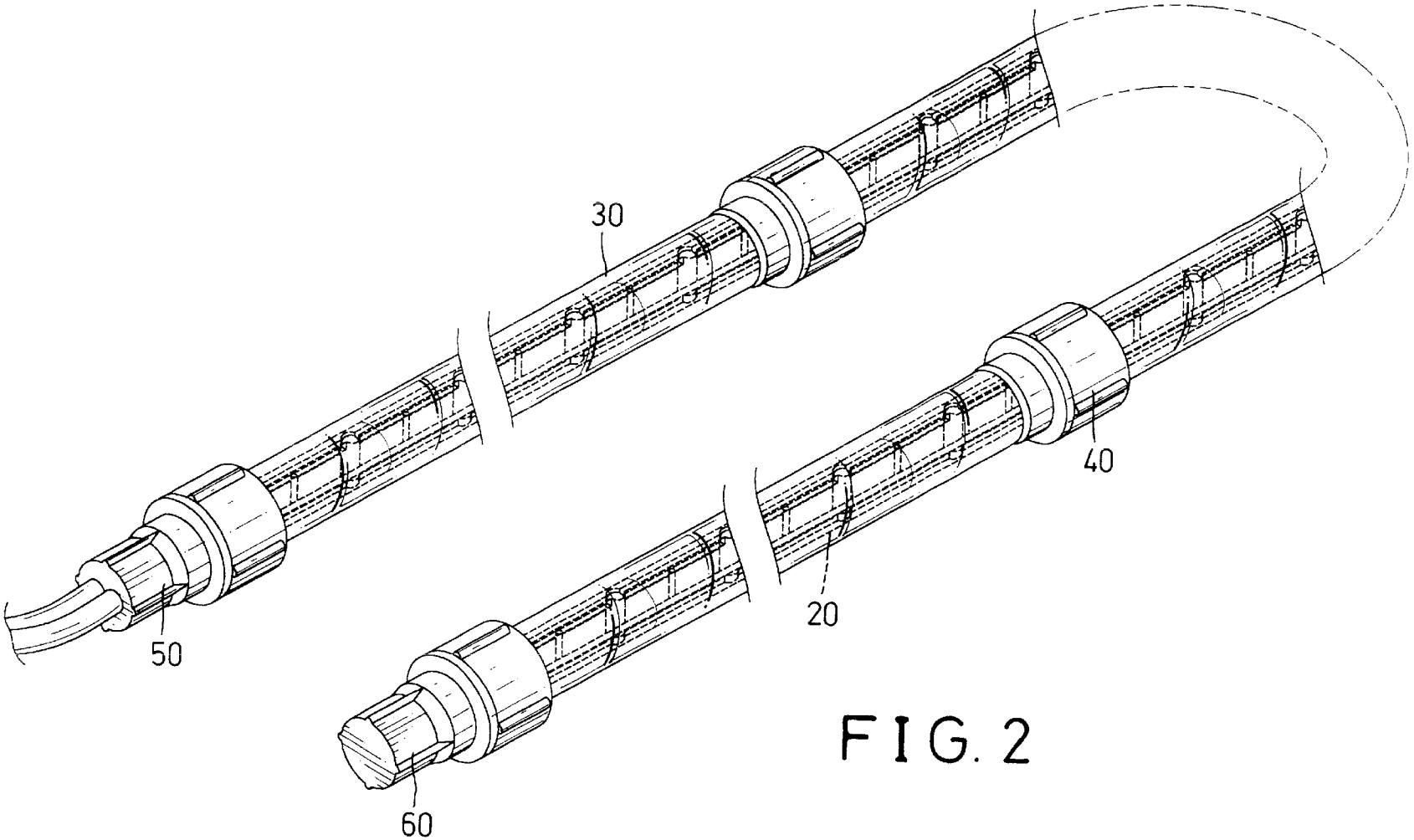
FIG. 2 is a fragmentary view of an embodiment of the decorative light of FIG. 1 having a series of units.

Referring to FIG. 2, there is shown a fragmentary view of an embodiment of the colorful light that has a series of units in quantity N. If each unit here has 3 differently-colored areas, the whole light will present different colors in total quantity of 3×N, which, indeed, gives a fancy decoration.

The units can be connected sequentially by a plurality of intermediate connectors (40), with a front connector (50) mounted to the first unit and a back plug (60) mounted to the last unit.

From the above description, it is noted that the invention has the advantage of being colorful and hence provides a fancy decoration.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A colorful decorative light comprising:

a length of flexible core (10) provided with mini-bulbs (12) and wires (14) electrically connecting to said mini-bulbs (12);

a substantially transparent outer covering (30) encasing said core (10); and a colorful and transparent cladding (20) arranged between said core (10) and said outer covering (30).

2. The colorful decorative light as claimed in claim 1, wherein said cladding (20) is embodied as a coating of color paint.

3. The colorful decorative light as claimed in claim 1, wherein said cladding (20) is embodied as colored band(s) wound around said core (10).

4. The colorful light as claimed in claim 1, wherein said cladding (20) is embodied as a plurality of colored sleeves mounted around said core (10).

5. The colorful decorative light as claimed in claim 1, further comprising at least one intermediate electrical connector mechanically and electrically connecting respective axially disposed units of the decorative light.

6. The colorful decorative light as claimed in claim 1, further comprising a front electrical connector mounted to one end of the decorative light for powering same, and a back plug mounted to the opposite end of the decorative light.

* * * * *